US009205621B2

(12) United States Patent
Cheich

(10) Patent No.: US 9,205,621 B2
(45) Date of Patent: Dec. 8, 2015

(54) APPARATUS AND METHOD FOR MAKING A WRAPPABLE PACKAGING PRODUCT

(75) Inventor: Robert C. Cheich, Independence, OH (US)

(73) Assignee: Ranpak Corp., Painesville, OH (US)

( * ) Notice: Subject to any disclaimer, the term of this patent is extended or adjusted under 35 U.S.C. 154(b) by 2576 days.

(21) Appl. No.: 11/814,870

(22) PCT Filed: Jan. 26, 2006

(86) PCT No.: PCT/US2006/002786

§ 371 (c)(1),
(2), (4) Date: Jul. 26, 2007

(87) PCT Pub. No.: WO2006/081356

PCT Pub. Date: Aug. 3, 2006

(65) Prior Publication Data

US 2008/0011749 A1 Jan. 17, 2008

Related U.S. Application Data

(60) Provisional application No. 60/647,114, filed on Jan. 26, 2005.

(51) Int. Cl.
*B31B 1/00* (2006.01)
*B31D 5/00* (2006.01)

(52) U.S. Cl.
CPC ..... *B31D 5/0069* (2013.01)

(58) Field of Classification Search
USPC ..... 493/464, 459, 407, 350, 352, 967
See application file for complete search history.

(56) References Cited

U.S. PATENT DOCUMENTS 2,045,733 A * 6/1936 Spafford ..... 428/177
2,228,236 A * 1/1941 Stratton ..... 156/467

(Continued)

FOREIGN PATENT DOCUMENTS

DE 20105559 6/2001
EP 0 650 827 A2 5/1995

(Continued)

OTHER PUBLICATIONS

International Search Report of International Application No. PCT/US2006/002786, published on Aug. 3, 2006 as International Publication No. WO 2006/081356 A1.

(Continued)

*Primary Examiner* — Sameh Tawfik
(74) *Attorney, Agent, or Firm* — Renner, Otto, Boisselle & Sklar, LLP

(57) ABSTRACT

A packaging system (10) includes a supply (12) of stock material (14) having a cohesive on a surface thereof and an apparatus (16) for converting the stock material (14) into a packaging product (20). The apparatus (16) includes at least one crumpling assembly (22) that can advance stock material (14) from the supply (12) and can cause the stock material (14) to randomly crumple. The apparatus (16) also includes a joining assembly (24) that can bring the crumpled stock material (26) together with uncrumpled stock material (28). The crumpled stock material (26) and the uncrumpled stock material (28) each have a cohesive on at least a portion of mutually facing surfaces such that the cohesive portions on those surfaces bond together when they come into contact with each other, thereby securing the crumpled stock material (26) to the uncrumpled stock material (28).

6 Claims, 5 Drawing Sheets

(56) References Cited

U.S. PATENT DOCUMENTS

| | | | | | |
|---|---|---|---|---|---|
| 2,502,112 | A | * | 3/1950 | Walker | 156/204 |
| 3,096,879 | A | | 7/1963 | Schumacher | |
| 3,642,967 | A | * | 2/1972 | Doll | 264/51 |
| 4,237,776 | A | | 12/1980 | Ottaviano | |
| 4,286,006 | A | | 8/1981 | Boelter | |
| 4,773,534 | A | | 9/1988 | DeHeras et al. | |
| 5,203,761 | A | * | 4/1993 | Reichental et al. | 493/346 |
| 5,323,896 | A | | 6/1994 | Jones | |
| 5,439,730 | A | * | 8/1995 | Kelly et al. | 428/156 |
| 5,538,778 | A | | 7/1996 | Hurwitz et al. | |
| 5,558,923 | A | * | 9/1996 | Vesamaa | 428/154 |
| 5,569,147 | A | * | 10/1996 | Erhard-Hollmann | 493/423 |
| 5,661,955 | A | | 9/1997 | Maida et al. | |
| 5,667,871 | A | | 9/1997 | Goodrich et al. | |
| 5,683,781 | A | | 11/1997 | Komarek et al. | |
| 5,698,293 | A | | 12/1997 | Nordlund et al. | |
| 5,733,403 | A | | 3/1998 | Morley | |
| 5,782,735 | A | | 7/1998 | Goodrich et al. | |
| 5,910,089 | A | * | 6/1999 | Weder | 53/472 |
| 6,017,299 | A | | 1/2000 | Ratzel | |
| 6,053,324 | A | | 4/2000 | Weder | |
| 6,067,779 | A | * | 5/2000 | Weder | 53/472 |
| 6,189,297 | B1 | | 2/2001 | Weder | |
| 6,202,390 | B1 | | 3/2001 | Weder | |
| 6,419,867 | B1 | | 7/2002 | Lang et al. | |
| 6,532,721 | B1 | | 3/2003 | Weder | |
| 6,546,701 | B2 | | 4/2003 | Weder et al. | |
| 2001/0055656 | A1 | | 12/2001 | Weder | |

FOREIGN PATENT DOCUMENTS

| | | | |
|---|---|---|---|
| EP | 0 888 879 | A1 | 1/1999 |
| EP | 0 908 397 | | 4/1999 |
| EP | 0 968 929 | | 1/2000 |
| FR | 2 248 938 | A1 | 5/1975 |
| WO | 99/16613 | A1 | 4/1999 |
| WO | 01/89936 | | 11/2001 |

OTHER PUBLICATIONS

International Search Report of International Application No. PCT/US2006/002792; published on Aug. 3, 2006 as International Publication No. WO 2006/081630 A2.

* cited by examiner

APPARATUS AND METHOD FOR MAKING A WRAPPABLE PACKAGING PRODUCT

This application claims the benefit of International Patent Application No. PCT/US2006/002786, filed Jan. 26, 2006, published in English as Publication No. WO 2006/081356 A1, which claims the benefit of U.S. Provisional Application No. 60/647,114, filed Jan. 26, 2005, both of which are hereby incorporated herein.

FIELD OF THE INVENTION

This invention relates generally to a packaging system and method, and more particularly to a packaging system and method using a stock material having a cohesive on a surface thereof to form a wrappable packaging product.

BACKGROUND

In the process of transporting an article from one location to another a protective packaging material typically is placed in a container around the article to fill any voids or to cushion the article or both during the transportation process.

One type of cushioning protective packaging material is disclosed in U.S. Pat. No. 5,558,923, and includes superimposed paper courses that form a package padding material. The padding includes a pleated course bounded by a pair of courses mechanically joined to the pleated course by punchings therethrough. Such a package padding material can be used as a cushion or a wrap or void fill.

Another cushioning protective packaging material is disclosed in U.S. Pat. No. 6,017,299 which advances a sheet stock material through a series of assemblies that cooperate to crumple the stock material with an arrangement of folds that can form a herringbone pattern. This cushioning product is relatively flat and has the flexibility to wrap around an object, yet still functions to cushion and/or protect the object.

SUMMARY

The present invention provides a packaging system and method using a stock material having a cohesive on at least one surface thereof to form a packaging product. The packaging product comprises a first layer of randomly crumpled stock material and a second layer of uncrumpled stock material, wherein the first layer and the second layer are attached to each other by a cohesive disposed on at least a portion of each of mutually facing surfaces of the first layer and the second layer.

More particularly, the present invention provides an apparatus for converting a stock material into a packaging product comprising at least one crumpling assembly that can advance a stock material and cause the stock material to randomly crumple, and a joining assembly that can bring the crumpled stock material together with uncrumpled stock material. The crumpled stock material and the uncrumpled stock material each have a cohesive on at least a portion of mutually facing surfaces to secure the crumpled stock material to the uncrumpled stock material.

The present invention also provides a method of making a packaging product that includes the steps of: randomly crumpling a stock material having a cohesive material on at least one surface thereof, and attaching the crumpled stock material and an uncrumpled sheet stock material, each having a cohesive material on at least one surface. The crumpled stock material and the uncrumpled stock material are attached by bringing at least one cohesive portion of the crumpled stock material together with at least one corresponding cohesive portion of the uncrumpled stock material.

The present invention also provides a packaging product produced by a process that includes the following steps: randomly crumpling a stock material having a cohesive material on at least one surface thereof to form a crumpled stock material, and combining the crumpled stock material with an uncrumpled stock material having a cohesive material on at least one surface thereof by bringing the respective cohesive portions together.

The foregoing and other features of the invention are hereinafter fully described and particularly pointed out in the claims. The following description and annexed drawings set forth in detail certain illustrative embodiments of the invention, these embodiments being indicative, however, of but a few of the various ways in which the principles of the invention can be employed.

DETAILED DESCRIPTION

The present invention provides a packaging system and method for making a packaging product from a stock material having a cohesive on at least one surface thereof. The cohesive provides benefits in converting the stock material into a packaging product, using the packaging product to wrap or otherwise pack one or more articles, or enhances one or more properties of the packaging product to provide different performance characteristics in comparison to a packaging product without the cohesive material.

Figure 1:
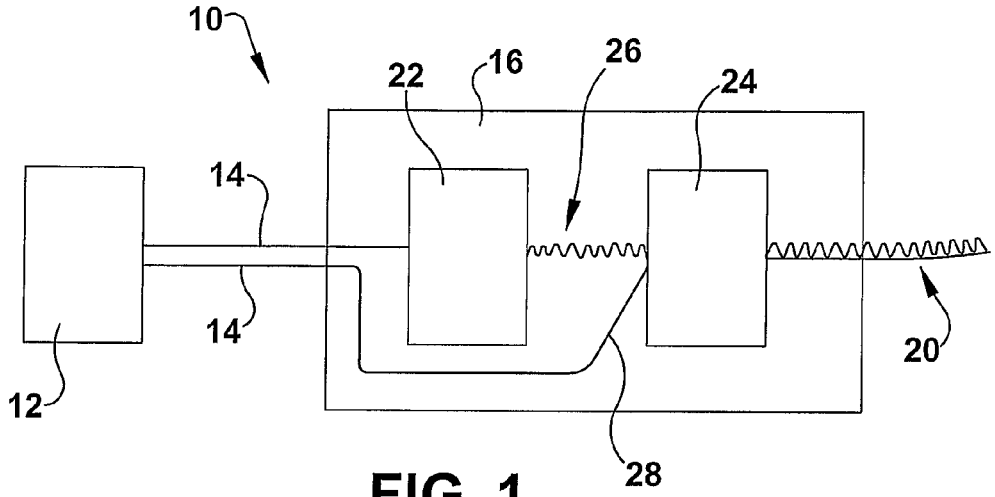
FIG. 1 is a schematic view of a system in accordance with the present invention.

Referring initially to FIG. 1, an exemplary packaging system 10 in accordance with the present invention includes a supply 12 of stock material 14 having a cohesive on a surface thereof and an apparatus 16 for converting the stock material 14 into a packaging product 20. The apparatus 16 includes at least one crumpling assembly 22 that can the advance stock material 14 from the supply 12 thereof and cause the stock material 14 to randomly crumple. The apparatus 16 also includes a joining assembly 24 that can bring the crumpled stock material 26 together with uncrumpled stock material 28. The crumpled stock material 26 and the uncrumpled stock material 28 each have a cohesive on at least a portion of mutually facing surfaces that bond together when they come into contact with each other, thereby securing the crumpled stock material 26 to the uncrumpled stock material 28.

The supply of stock material 12 generally includes a sheet stock material, such as paper or plastic, having one or more plies, with a cohesive on a surface of at least one ply. The stock material can be provided as a continuous roll or fan-folded stack, or as discrete sheets. A cohesive, unlike an adhesive, only attaches to itself and generally will not stick to other items, such as non-cohesive-coated portions of the stock material or a converting apparatus. No heat or supplementary closure materials, such as adhesive glue, mechanical staples, tape or other bonding strips, for example, are necessary to hold the crumpled and uncrumpled stock material together in view of the cohesive.

The cohesive on the stock material can stiffen the stock material and the resulting packaging product and can increase its strength. The cohesive can be selected to enhance one or more properties in the packaging product, however, such as the aforementioned stiffness of the packaging product or portion of the packaging product, enhanced strength, etc. The cohesive also can provide benefits in the use of the resulting packaging product, such as to hold multiple packaging products or portions thereof together in a particular orientation, such as a pouch.

Figure 2:
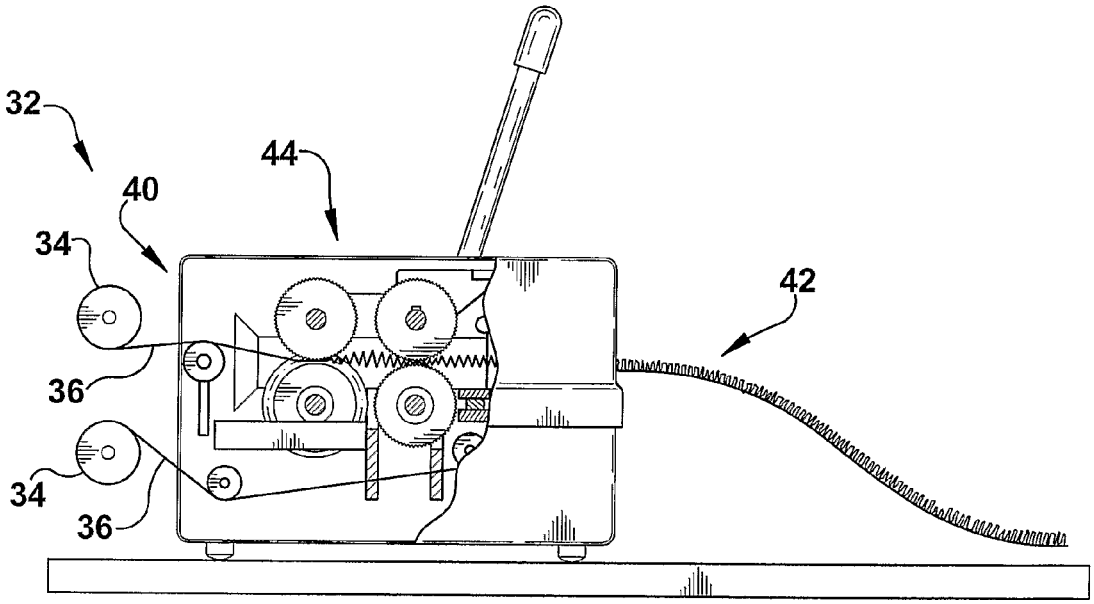
FIG. 2 is a side view of an exemplary packaging system in accordance with the present invention with a portion of a housing removed to show components of the various assemblies of an apparatus.
Figure 3:
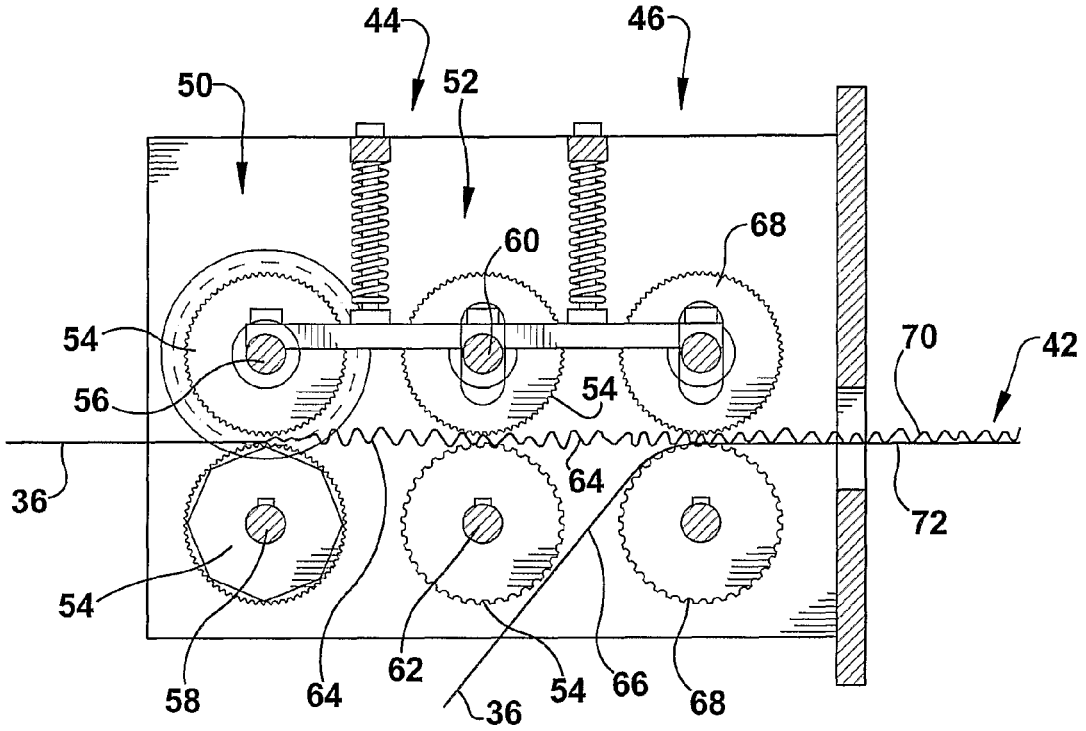
FIG. 3 is an enlarged side view of the assemblies of the apparatus of FIG. 2.
Figure 4:
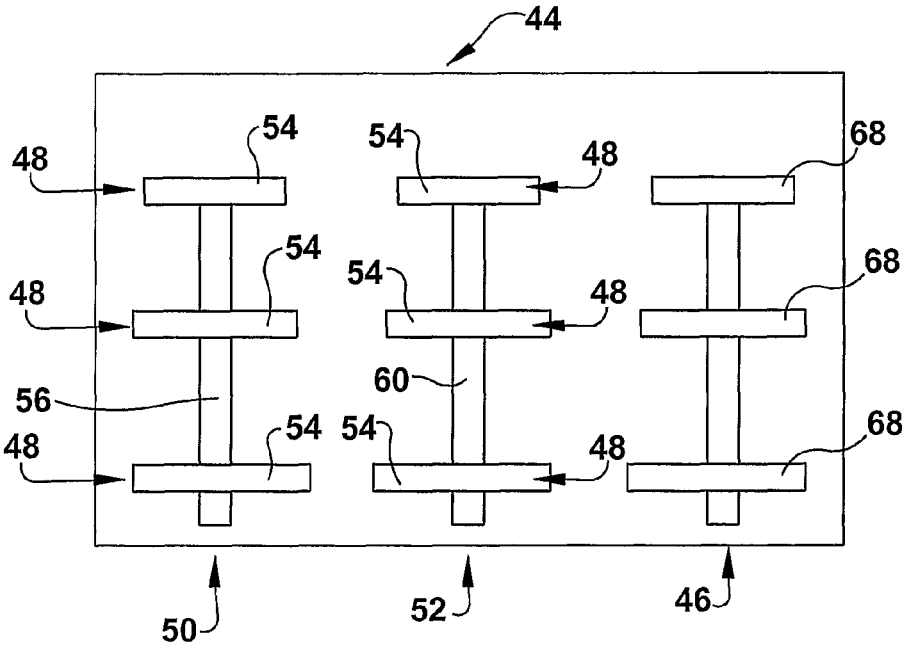
FIG. 4 is a schematic plan view of the apparatus of FIG. 3.

Turning to FIGS. 2-4, an exemplary embodiment of a system 32 in accordance with the present invention includes a supply of stock material, such as rolls 34 of continuous sheet stock material 36 and an apparatus 40 for converting the stock material 36 into a packaging product 42. The apparatus 40 includes a crumpling assembly 44 and a joining assembly 46. In the embodiment shown in FIGS. 2-4 the crumpling assembly 44 includes a first assembly 50 to feed the stock material 36 therethrough at a first rate and a longitudinally-spaced second assembly 52 to feed the stock material 36 therethrough at a second rate that is slower than the first rate. This difference in feed rates causes longitudinal crumpling in the stock material 36. The crumpling assembly 44 also can laterally crumple the stock material 36, thereby reducing the lateral dimension of the crumpled stock material 36. The illustrated crumpling assembly 44 includes a plurality of laterally-spaced crumpling assemblies that cooperate to cause longitudinal or longitudinal and lateral crumpling in the stock material 36.

Both the crumpling assembly 44 and the joining assembly 46 generally include laterally-spaced pairs of rotating members 54 that cooperate to crumple, advance, and join the stock material therebetween. To cause the lateral crumpling mentioned above, respective laterally outer pairs of rotating members 54 can include a staggered arrangement of flat faces on the rotating members that will cause the stock material to be advanced alternately from each side of its longitudinal axis, instead of being pulled only axially. This advance by successive pulls from one side and then the other side back and forth makes it possible to have at the center of the stock material a surplus of stock material with respect to its flat sheet configuration, this surplus being generated by a rib on one rotating member fitting in a mating groove in an opposing rotating member of the pair. This results in lateral crumpling of the stock material.

With particular reference to FIGS. 3 and 4, the first assembly 50 includes three laterally-spaced crumpling assemblies 48 mounted to a pair of rotatable shafts 56, 58. The second assembly 52 includes three laterally-spaced crumpling assemblies 48 downstream of the first crumpling assembly 50 mounted to another pair of rotatable shafts 60, 62. The first assembly 50 is configured to advance the stock material 36 drawn from the supply 34 at a first rate, and the second assembly 52 is configured to advance the stock material at a second rate that is slower than the rate of the first assembly 50. The stock material 36 randomly crumples as it gathers behind the slower-advancing second assembly 50. This crumpling tends to reduce the longitudinal and transverse dimensions of the stock material 36 and cohesive portions that come into contact with one another as the stock material crumples bind together and thereby help the crumpled stock material maintain is crumpled state.

The joining assembly 46, located proximate the downstream end of the crumpling assembly 44, brings the crumpled stock material 64 together with uncrumpled stock material 66. Similar to the crumpling assembly 44, the joining assembly 46 generally includes upper and lower pairs of rotating members 68 configured to advance the stock material therebetween. The joining assembly 46 is configured to compressively engage the crumpled stock material with the uncrumpled stock material, pressing together respective cohesive portions of the crumpled and uncrumpled stock material, whereupon the cohesive portions become bound together and thereby secure the crumpled stock material 64 to the uncrumpled stock material 66.

The resulting packaging product 42 generally includes a first layer of randomly crumpled stock material 70 attached by the respective cohesive portions to a second layer of uncrumpled stock material 72. The uncrumpled stock material thus secured to the crumpled stock material tends to hold the uncrumpled stock material in its crumpled state. The crumpled stock material can be secured to the uncrumpled stock material in any suitable orientation. For example, the crumpled stock material can be centered on the uncrumpled stock material or offset such that at least one laterally outer edge of the uncrumpled stock material extends beyond a respective laterally outer edge of the crumpled stock material. As noted below, the crumpled stock material, for example, can be free of cohesive in some applications.

Figure 5:
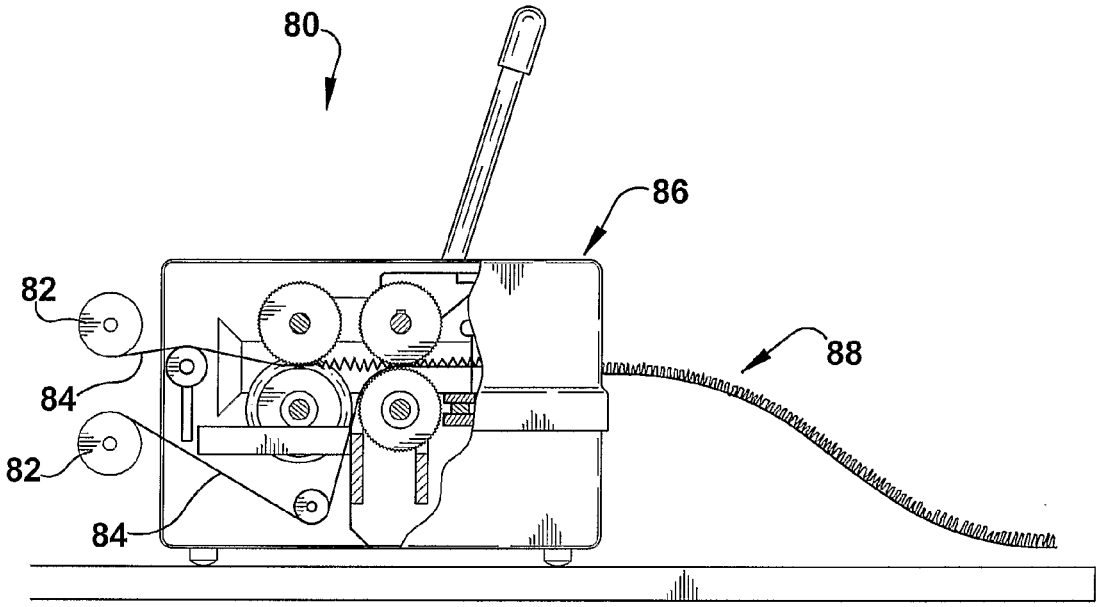
FIG. 5 is a side view of another exemplary packaging system in accordance with the present invention with a portion of a housing removed to show components of the various assemblies of an apparatus.
Figure 6:
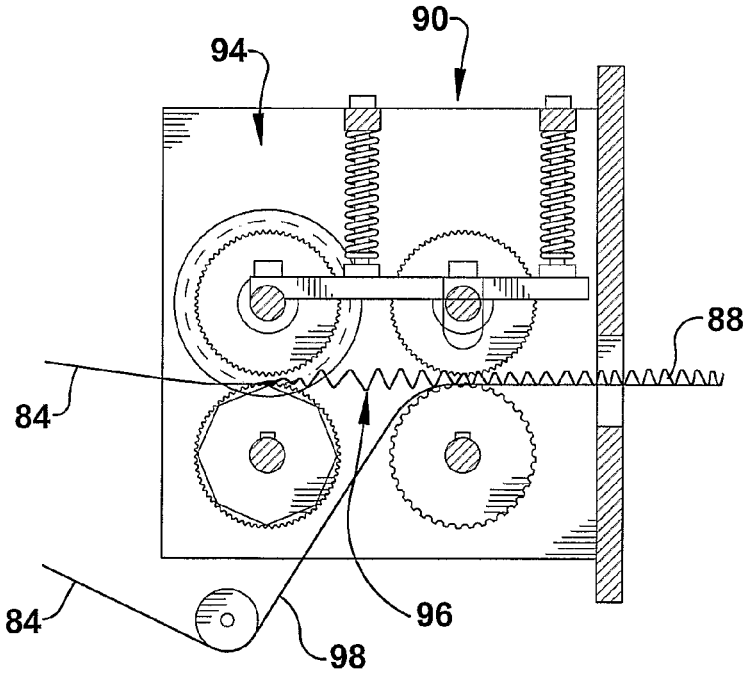
FIG. 6 is an enlarged side view of the assemblies of the apparatus of FIG. 5.

Turning to FIGS. 5 and 6, another exemplary system 80 in accordance with the present invention is shown. This system 80 also includes a supply 82 of stock material 84 and an apparatus 86 for converting the stock material 84 into a packaging product 88. The apparatus 86 is similar to the apparatus 40 of FIG. 3. In this embodiment, however, the downstream crumpling assembly 90 also is the joining assembly. Thus, the downstream or second assembly 90 advances the stock material 84 at a slower rate than the upstream assembly 94, thereby causing the stock material to crumple upstream thereof. At the same time, the downstream assembly 90 brings the crumpled stock material 96 together with uncrumpled stock material 98 so that respective cohesive portions on each stock material bind together to form the packaging product 88.

Figure 7:
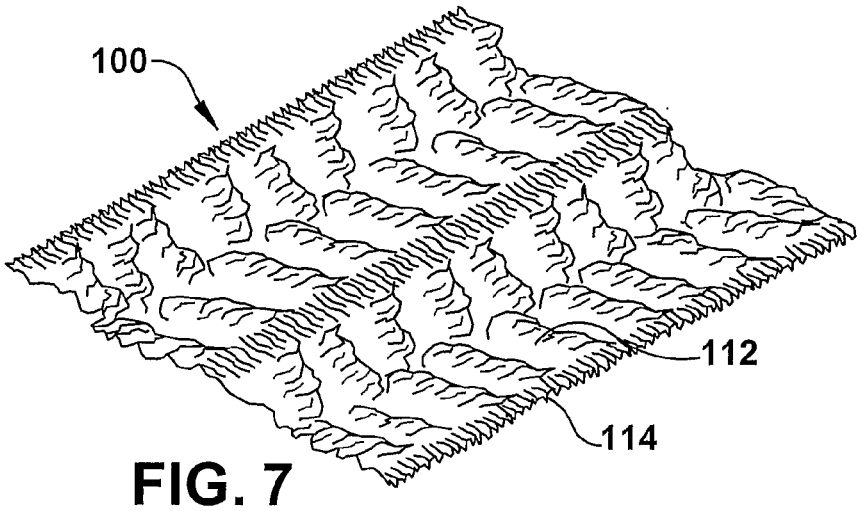
FIG. 7 is a perspective view of a packaging product in accordance with the present invention.

Turning to FIG. 7, as noted above a packaging product 110 in accordance with the present invention includes a first layer 112 of randomly crumpled stock material superimposed over and attached to a second layer 114 of uncrumpled stock material via a cohesive. The crumpled layer is coextensive with the uncrumpled stock material such that the lateral edge portions of each layer are generally aligned.

Figure 8:
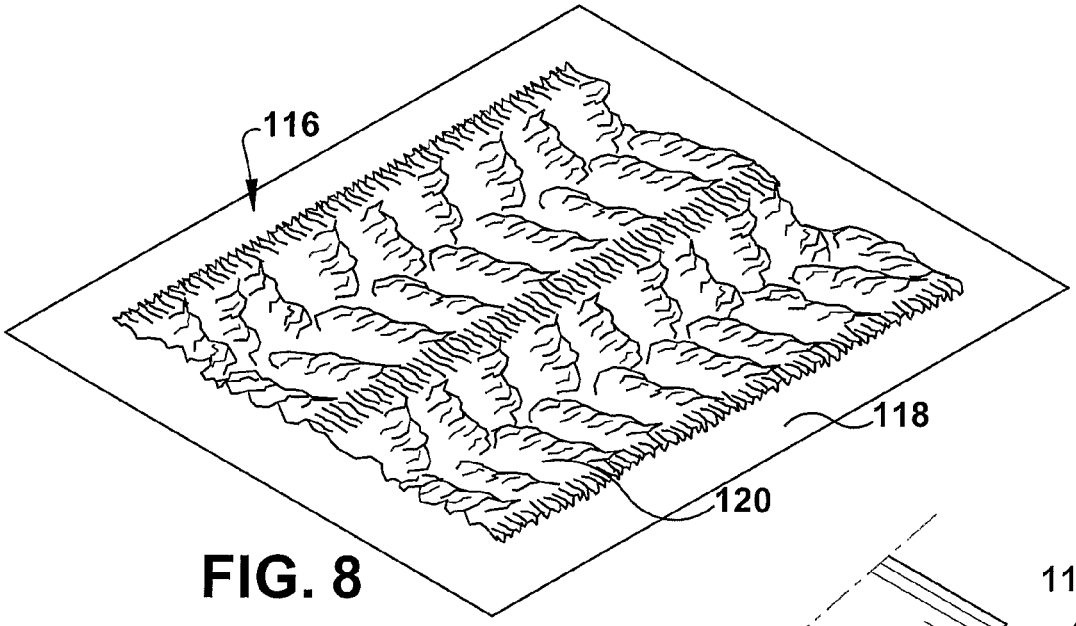
FIG. 8 is a perspective view of another packaging product in accordance with the present invention.
Figure 9:
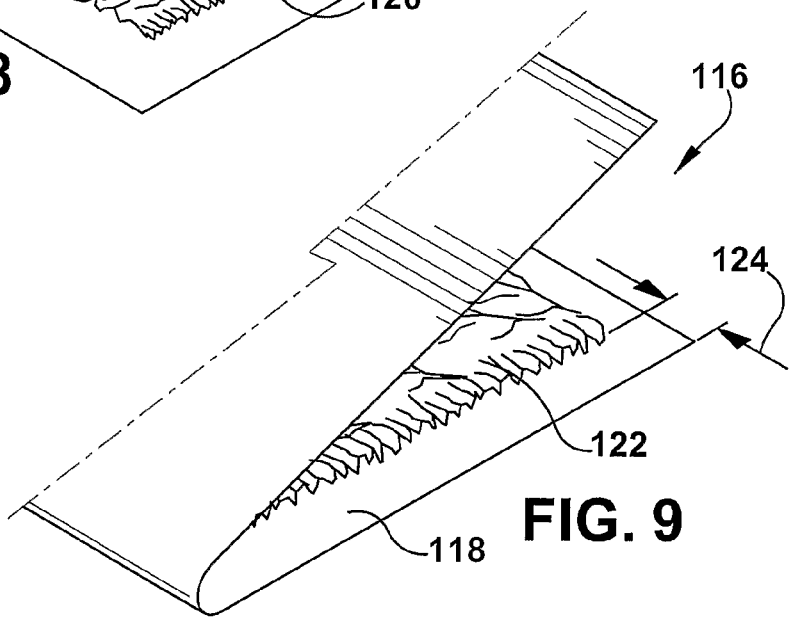
FIG. 9 is a perspective view of the packaging product of FIG. 8 partially folded along a transverse axis.

In FIGS. 8 and 9, a packaging product 116 in accordance with the present invention is shown wherein at least one laterally outer edge of a layer 118 of uncrumpled stock material extends beyond a respective laterally outer edge of a layer 120 of crumpled stock material. In this embodiment, the exposed edge of the uncrumpled stock material can include a cohesive on at least a portion of its surface. Typically the uncrumpled stock material and the crumpled stock material have cohesive over an entire surface, although for some applications cohesive can be omitted from the crumpled stock material. The cohesive on the exposed edge of the uncrumpled stock layer 118 can be used to secure the packaging product in a desired configuration after the packaging is manipulated into a desired position by bringing cohesive portions of the uncrumpled material together.

For example, as shown in FIG. 9, the packaging product 116 of FIG. 8 in accordance with the present invention can be folded along a transverse axis to bring laterally exposed cohesive portions 124 of the packaging product into engagement with on another. It will be appreciated that an article to be packaged can be placed on an unfolded sheet of the packaging product prior to folding the packaging product over. Once the packaging product is folded over and the laterally exposed cohesive portions 124 of the packaging product engage and bond to each other, the article is generally secured within a pouch formed by the folded packaging product. This is one of the situations where the cohesive on the uncrumpled stock material holds the package together, so cohesive is not necessary on the crumpled stock material. The article also can be placed in the pouch after the packaging product is folded.

Figure 10:
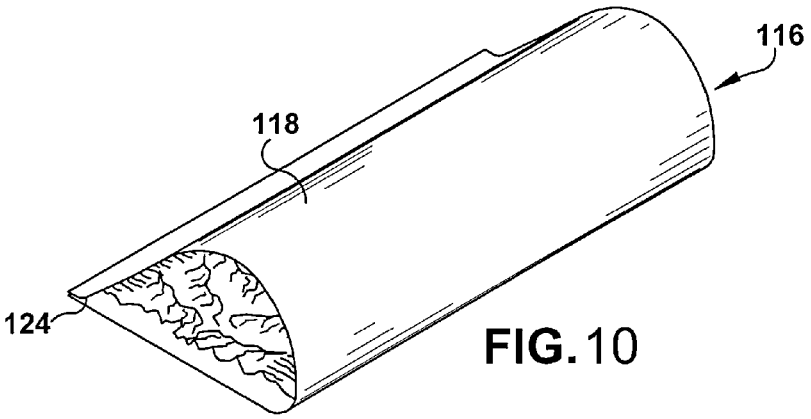
FIG. 10 is a perspective view of the packaging product of FIG. 8 folded along longitudinal axes.

Similarly, in FIG. 10 the packaging product 116 of FIG. 8 is folded along a longitudinal axis bringing opposing laterally-exposed edge portions 124 of the uncrumpled layer 118 into contact to form an open-ended enclosure. Conceivably, the packaging product 116 also could be rolled into a tubular or conical shape. If cohesive portions are provided on the ends as well, the ends of such a packaging product could be sealed with the article enclosed within.

Figure 11:
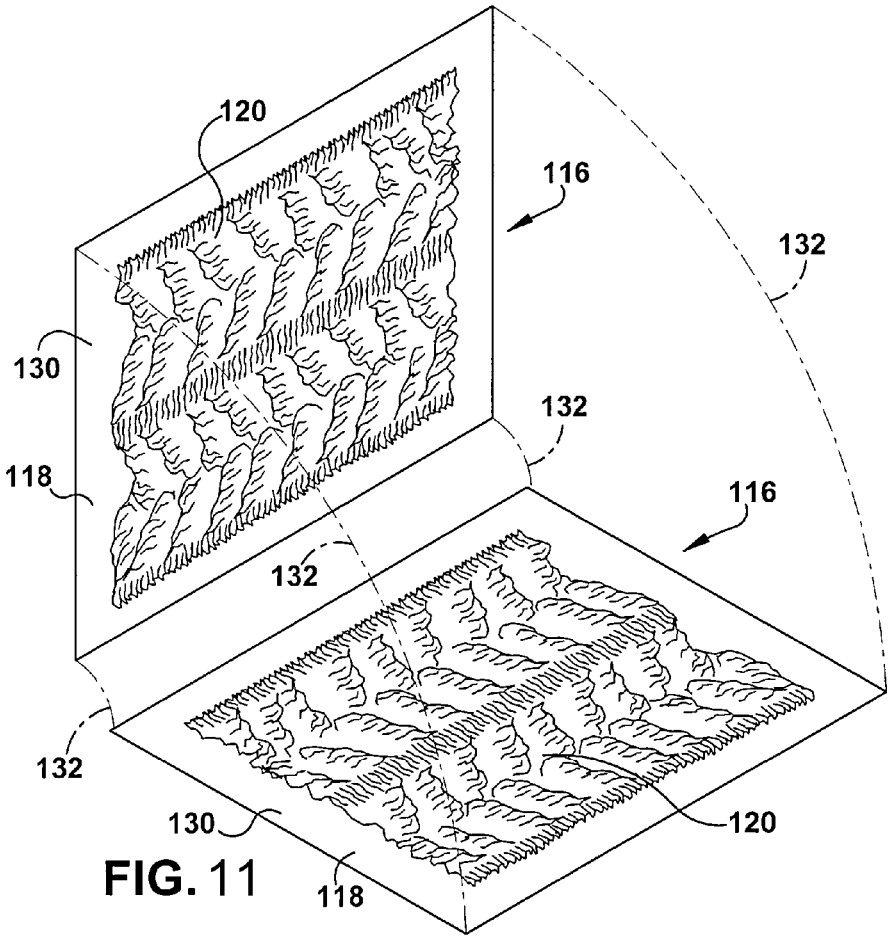
FIG. 11 is a perspective view of another packaging product in accordance with the present invention.

A pouch or other enclosure also could be formed from multiple sections of the packaging product 116 of FIG. 8, as shown in FIG. 11. The packaging product of FIG. 11 includes an exposed perimeter region 130 of the uncrumpled layer 118 having cohesive on at least a portion thereof. These sections of packaging product 116 can be used to form a sealed pouch by bringing the exposed cohesive portions in the perimeter region 130 of respective sheets 116 together to bond with each other, as shown by the arrows 132. For example, two sections can be used to sandwich an article to be shipped therebetween, wherein cohesive portions in the perimeter region 130 of the uncrumpled layer 118 of the stock material of each section are aligned and attached to respective cohesive portions in the perimeter regions 130 thereby sealing the article between the two sections.

As another alternative, a single ply of cohesive stock material can be used to form a dunnage product. The cohesive in this instance is placed on a surface of the stock material such that upon randomly crumpling the stock material different portions of the stock material having cohesive thereon come together, whereupon the cohesive portions bind together to hold the stock material in its crumpled state.

As should be apparent by now, the cohesive can be applied to the stock material in any manner that facilitates the conversion process or provides desired qualities in the resulting packaging product. The cohesive generally is placed on a surface of the stock material such that upon crumpling different portions of cohesive can be brought together whereupon they bind together to secure the crumpled stock material in its crumpled state. Alternatively, the cohesive can be applied to an uncrumpled stock material whereby the cohesive portions can be brought together to entrap a cohesive-free crumpled stock material and an article therebetween. A wide variety of arrangements of cohesive on the stock material are possible. The cohesive can be provided across an entire surface of the stock material or strategically applied in regularly or irregularly spaced, sized, oriented or shaped strips or patterns of cohesive on one or more surfaces of the stock material.

The present invention thus provides a system and method using a cohesive stock material to make and use the improved packaging product of the present invention. The cohesive can improve characteristics of the packaging product, help to maintain the crumpled stock material in its crumpled state, or help to maintain a configuration of the packaging product relative to itself or other packaging or dunnage products.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function (i.e., that is functionally equivalent), even though not structurally equivalent to the disclosed structure that performs the function in the herein illustrated embodiments of the invention. In addition, while a particular feature of the invention might have been described above with respect to only one of several illustrated embodiments, such a feature can be combined with one or more other features of another embodiment, as might be desired and advantageous for any given or particular application.

What is claimed:

1. An apparatus for converting a stock material into a packaging product, comprising:

a supply of sheet stock material having first and second plies, each ply having a cohesive on at least a portion of at least one face;

at least one crumpling assembly downstream of the supply that can advance the first ply of sheet stock material and cause the first ply of sheet stock material to randomly crumple; and a joining assembly at a downstream end of the crumpling assembly that can bring the crumpled first ply of sheet stock material together with the second ply of sheet stock material, the joining assembly bringing the cohesive faces of the crumpled first ply of sheet stock material and the second ply of sheet stock material together to secure the crumpled first ply of sheet stock material to the second ply of sheet stock material.

2. An apparatus as set forth in claim 1, wherein the crumpling assembly includes a plurality of laterally spaced crumpling assemblies that cooperate to cause longitudinal and lateral crumpling in the stock material.

3. An apparatus as set forth in claim 1, wherein the at least one crumpling assembly includes a first assembly to feed the stock material therethrough at a first rate and a longitudinally spaced second assembly to feed the stock material therethrough at a second rate that is slower than the first rate, thereby causing longitudinal crumpling in the stock material.

4. An apparatus as set forth in claim 3, wherein the longitudinally spaced second assembly is the joining assembly that can bring the crumpled first ply of sheet stock material together with the second ply of sheet-stock material.

5. An apparatus as set forth in claim 1, wherein the joining assembly can bring the crumpled first ply of sheet stock material together with the second ply of sheet stock material such that at least one laterally outer edge of the second ply of sheet stock material extends beyond a respective laterally outer edge of the crumpled first ply of sheet stock material.

6. An apparatus as set forth in claim 1, wherein the crumpling assembly can laterally crumple the first ply of sheet stock material thereby reducing the lateral dimension of the crumpled first ply of sheet stock material.

* * * * *